US008833461B2

(12) United States Patent
Varghese et al.

(10) Patent No.: US 8,833,461 B2
(45) Date of Patent: Sep. 16, 2014

(54) EXPANDABLE SOLID LOAD RING FOR CASING HANGER

(75) Inventors: Sibu Varghese, Houston, TX (US); Chad Yates, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 640 days.

(21) Appl. No.: 13/156,156

(22) Filed: Jun. 8, 2011

(65) Prior Publication Data

US 2012/0312542 A1 Dec. 13, 2012

(51) Int. Cl.
*E21B 33/043* (2006.01)

(52) U.S. Cl.
CPC ..... *E21B 33/043* (2013.01)
USPC ..... 166/348; 166/368; 166/382

(58) Field of Classification Search
CPC ..... E21B 33/043; E21B 33/04
USPC ..... 166/348, 360, 365, 368, 382, 75.14, 166/206; 285/123.1, 123.3, 123.4
See application file for complete search history.

(56) References Cited

U.S. PATENT DOCUMENTS 3,457,992 A * 7/1969 Brown ..... 166/335
3,472,530 A * 10/1969 Fowler ..... 285/3
4,460,042 A * 7/1984 Galle, Jr. ..... 166/217
4,528,738 A * 7/1985 Galle, Jr. ..... 29/416
4,550,782 A * 11/1985 Lawson ..... 166/382
4,595,063 A * 6/1986 Jennings et al. ..... 166/382
4,836,579 A * 6/1989 Wester et al. ..... 285/3
4,842,307 A * 6/1989 Sweeney et al. ..... 285/123.3
5,209,521 A * 5/1993 Osborne ..... 285/3
5,421,407 A * 6/1995 Thornburrow ..... 166/85.3
6,516,887 B2 * 2/2003 Nguyen et al. ..... 166/348
7,134,490 B2 * 11/2006 Nguyen ..... 166/208
7,380,607 B2 * 6/2008 Thomas ..... 166/348
7,441,594 B2 * 10/2008 Vanderford et al. ..... 166/75.14
8,066,064 B2 * 11/2011 Minassian et al. ..... 166/89.3
2012/0160511 A1 * 6/2012 Gette ..... 166/368

OTHER PUBLICATIONS

GB Search Report dated Aug. 30, 2012 from corresponding Application No. GB1210078.0

* cited by examiner

*Primary Examiner* — Matthew Buck
(74) *Attorney, Agent, or Firm* — Bracewell & Giuliani LLP

(57) ABSTRACT

A subsea wellhead assembly includes a housing with a bore. A hanger is lowered into the housing, the hanger having at least one downward facing load shoulder. An expandable load ring is carried on the hanger. When casing weight is applied to the hanger, the weight energizes the load ring, causing it to expand and thereby increase the contact area between a load shoulder on the load ring and a load shoulder on the housing. The shoulders create a path for the load to be transferred to the housing. The increase in contact area increases the load carrying capacity of the hanger. The load ring expansion is limited to elastic expansion to allow it to return to a retracted position when the casing weight is removed.

20 Claims, 3 Drawing Sheets

EXPANDABLE SOLID LOAD RING FOR CASING HANGER

FIELD OF THE INVENTION

This invention relates in general to wellhead equipment for oil and gas wells, and in particular to a solid load ring used with a casing hanger.

DESCRIPTION OF RELATED ART

A typical subsea wellhead assembly includes a wellhead housing that supports one or more casing hangers. One type of wellhead housing has a conical load shoulder machined within its bore. The casing hanger lands on and is supported by the load shoulder. In this type, the diameter of the housing bore below the load shoulder is less than the diameter of the housing above the load shoulder by a dimension equal to a radial width of the load shoulder.

In another type, referred to as "full bore", the wellhead housing has a groove with substantially the same diameter above and below the groove. The load shoulder is a split ring that is installed subsequently in the groove. The casing hanger is supported by the load shoulder. This procedure allows a larger diameter bore to be employed during drilling operations. The load shoulder may be installed on a special running tool or it may be run with the casing hanger.

Active casing hangers may be used to transfer the casing load to the wellhead housing via a loading mechanism that includes an activation ring, shear pins that prevent premature movement of the activation ring, and a load ring on the casing hanger. This mechanism is typically designed to be activated by the weight of the string when a reaction point, such as a shoulder, formed on the interior of the wellhead housing is reached during lowering of the hanger. At this point, the shear pins on the activation ring break to allow it to slide relative to the downward movement of the hanger, thereby allowing the load ring on the hanger to align with the housing to transfer casing load to the housing. This also increases the bearing area of the casing hanger. However, if the hanger snags or the pins load up unevenly and break prematurely, the activation ring may be activated prematurely. This is costly and time consuming as the hanger and casing would have to be pulled out and re-tripped.

A technique is thus desirable that correctly and reliably activates the loading mechanism on a casing hanger to prevent premature activation.

SUMMARY OF THE INVENTION

In an example embodiment a wellhead housing has a bore containing at least one generally upward facing load shoulder that inclines relative to an axis of the bore. A housing or landing sub load ring with a corresponding downward facing shoulder is supported by the load shoulder on the wellhead housing. The housing load ring has a generally upward facing shoulder that inclines relative to the bore axis. A casing hanger landed in the housing has a at least one conical downward facing load shoulder that inclines relative to the axis of the bore. A hanger load ring is carried by the hanger for supporting the hanger on the upward facing load shoulder. The hanger load ring in this example is solid, with the critical part of the load ring being its ability to elastically expand when energized by the weight of casing supported by the hanger. This elastic expansion of the hanger load ring occurs between a differential angle of the hanger and the housing load ring. Thus, elastic expansion occurs if there exists a differential angle between the mating surfaces of the hanger load ring.

The load ring has an inner profile that slidingly engages the downward facing load shoulder of the hanger at an angle and an outer profile that slidingly engages the upward facing load shoulder of the housing load ring at a second angle. The hanger load ring may be carried by the hanger for movement between a retracted position, wherein the outer profile is spaced radially overlapping a portion of the upward facing shoulder of the housing load ring, and an expanded position wherein the outer profile expands radially outward until it is stopped by a retainer ring located within a pocket formed in the housing. The retainer ring prevents the hanger load ring from radially expanding past the elastic zone for a given material. The hanger can thus be rated to a higher load carrying capability due to extra bearing contact made available as the casing weight is increased.

When set, the load rings and shoulders provide a path for the casing load to be transferred to the wellhead housing. This invention gives some of the benefit of a traditional expanding load shoulder without the major drawback of having a mechanism that can trigger unexpectedly. Because the load shoulder is a solid ring, with no interruptions or weakened points, it should remain as reliable as a solid casing hanger. However, because the hanger load ring is allowed to expand with increased casing hanger loads, it can achieve higher capacities than a simple load shoulder.

During operation, the downward casing weight W is greater then the normal force N and frictional resistance Fn and the angle $\theta_1$ i.e. the angle between the load ring and casing hanger is greater than angle $\theta_2$ i.e. angle between the casing hanger load ring and housing load ring. The hanger load ring will begin to elastically expand when energized by the casing weight and provided that the mating surface is in complete contact with the landing surface.

DETAILED DESCRIPTION OF THE INVENTION

Figure 1:
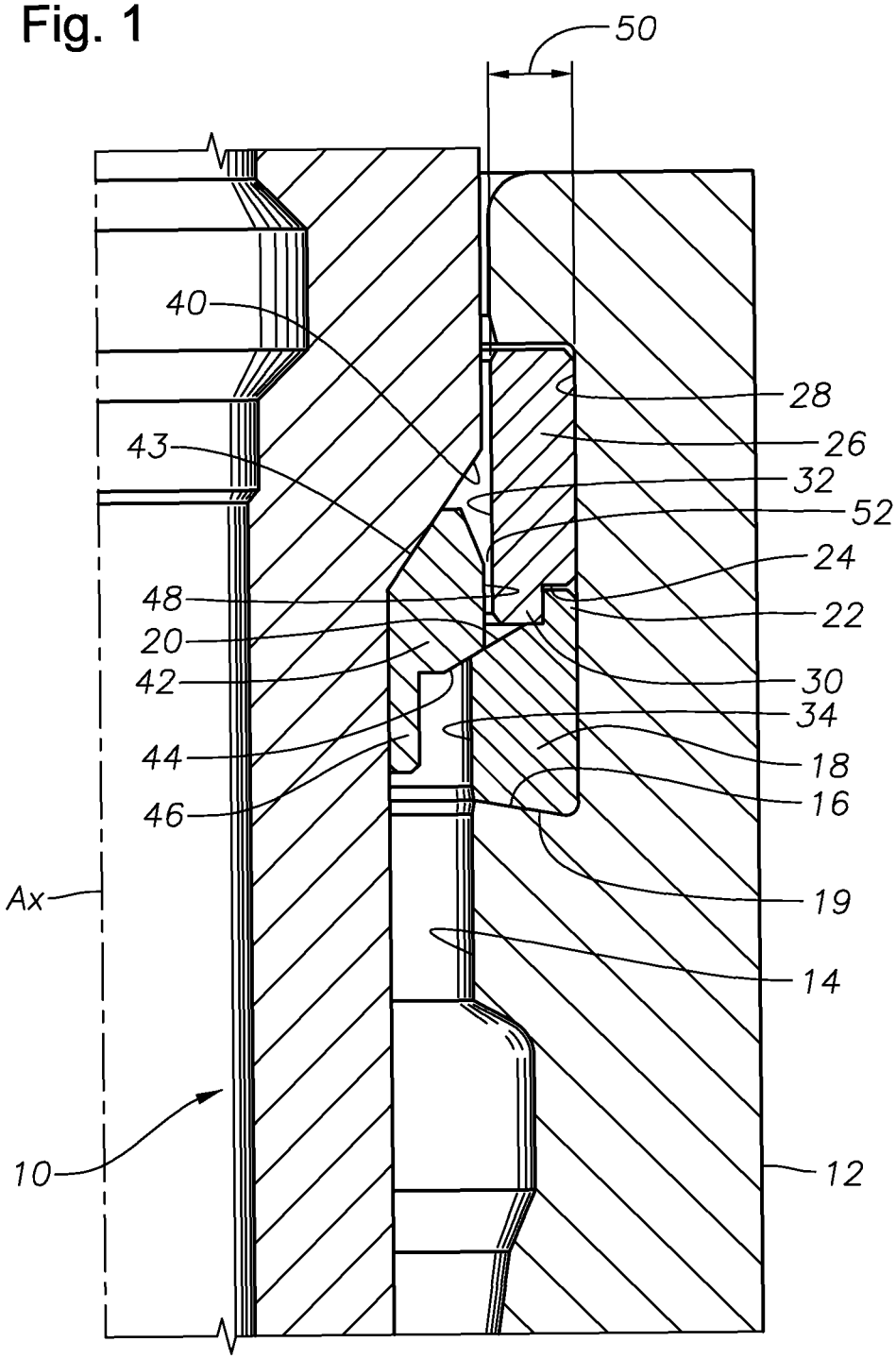
FIG. 1 is a side sectional view of a casing hanger and hanger load ring shown within a wellhead housing in an unset position, and constructed in accordance with this invention.

The apparatus and method of the present disclosure will now be described more fully hereinafter with reference to the accompanying drawings in which embodiments are shown. This subject of the present disclosure may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the subject of the present disclosure is not limited to the exact details of construction, operation, exact materials, or embodiments shown and described, as modifications and equivalents will be apparent to one skilled in the art. In the drawings and specification, there have been disclosed illustrative embodiments of the subject disclosure and, although specific terms are employed, they are used in a generic and descriptive sense only and not for the purpose of limitation. Accordingly, the subject disclosure is therefore to be limited only by the scope of the appended claims.

Referring to FIG. 1, a casing hanger 10 is shown in the unset position within a landing sub or wellhead housing 12 having an axial bore 14. Bore 14 has an upward facing tapered shoulder 16 formed within. In this embodiment, the shoulder 16 inclines downward relative to an axis of the bore 14. Shown resting on the shoulder 16 is an annular housing load ring 18 whose lower surface defines a downward facing shoulder 19 with a slope corresponding to the load shoulder 16. The upper surface of the housing load ring 18 has a generally upward facing shoulder 20 that inclines relative to the bore axis $A_X$. An upper cylindrical extension 22 is formed on an exterior surface of the housing load ring 18 that interacts with a corresponding recess 24 formed on an annular retainer or stopper ring 26 carried by the housing 12. Alternatively, housing load ring 18 may be eliminated wherein casing load may be transferred directly to housing shoulder 16. In some cases, the goal is to increase the load carrying capability of the hanger so a high strength material can be used where the load rings from the hanger and housing react against each other. If the load ring is separate from the housing, the cost of the entire housing can be reduced by installing a high strength load ring at the specific location where the hanger lands. If load ring is integrated into housing, the cost of the housing will increase since the housing has to have the same strength of the load ring on the casing hanger. The annular retainer ring 26 in this embodiment is located within a recess 28 formed within the bore 14 of the housing 12. The retainer ring 26 may be a split ring and maintains the housing load ring 18 in an assembled position on the housing 12. A lower end 30 of the retainer ring 26 contacts a portion of the shoulder 20 on the housing load ring 18. An inner surface 32 of the retainer ring 26 is recessed radially outward compared to an inner surface 34 of the housing load ring 18. The housing load ring 18 and retainer ring 26 may be assembled onto housing 12 prior to installation of housing 18. The casing hanger 10 may be lowered within housing 18 after housing load ring 18 and retainer ring 26 are installed. The stopping function of the retainer ring 26 will be discussed in further detail in a subsequent section.

Continuing to refer to FIG. 1, the casing hanger 10 in this embodiment has at least one downward facing load shoulder 40 that inclines relative to the axis $A_X$ of the housing bore 14. A hanger load ring 42, which may be of solid annular construction, is carried on the outer circumference of the hanger 10 for supporting the hanger 10 on the housing load ring 18. In this embodiment, the hanger loading ring 42 is free of any splits or slots and extends a full 360 degrees. However, the loading ring 42 may also be fabricated to include at least one split or slot in the inner or outer diameter, or both, to increase the flexibility of the loading ring 42. The hanger load ring 42 is a steel member and may expand within its elastic limits as force is applied to it. The hanger load ring 42 has an upward facing, tapered shoulder 43, that will be described in more detail below, that slidingly engages the downward facing load shoulder 40 of the hanger 10. The hanger load ring 42 also includes a downward facing, tapered shoulder 44 that slidingly engages a portion of the upward facing load shoulder 20 of the housing load ring 18. A lower cylindrical extension 46 extends downward from the downward shoulder 44 of the hanger load ring 10 and is in contact with the outer circumference of the hanger 10. An exterior surface 48 of the housing load ring 42 protrudes radially outward past the inner surface 34 of the housing load ring 18. Initially, a gap or clearance 52 exists between the exterior surface 48 of the hanger load ring 42 and the inner surface 32 of the retainer ring 26. Clearance 52 can be, for example, between 0.050 inches and 0.100 inches for an outer diameter of load ring 42 that is between 9 inches to 13 inches. The inner surface 32 of the retainer ring 26 provides a stopping function that prevents the hanger load ring 42 from expanding past its elastic limits when the hanger 10 is set as shown in FIG. 2.

Figure 2:
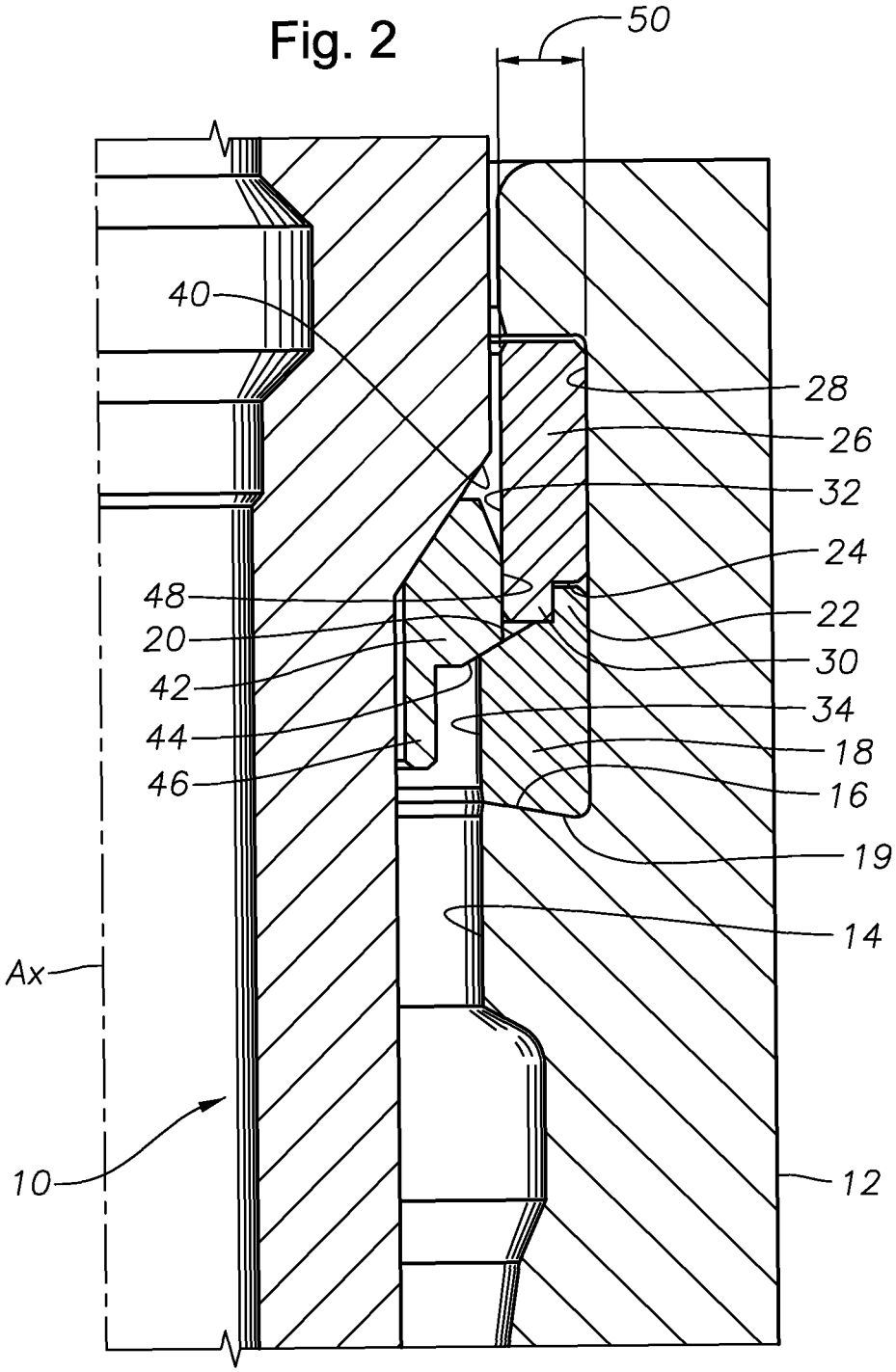
FIG. 2 is a side sectional view of the casing hanger and hanger load ring shown in FIG. 1 within the wellhead housing in a set position.

The hanger load ring 42 in this embodiment is carried by the hanger 10 for movement between a retracted position, wherein the outer surface 48 is spaced radially overlapping the upward facing shoulder 20 of the housing load ring, and an expanded position, shown in FIG. 2, wherein the exterior surface 48 expands radially outward until it is stopped by the inner surface 32 of the retainer ring 26 located within the pocket 28 formed in the housing 12.

Figure 3:
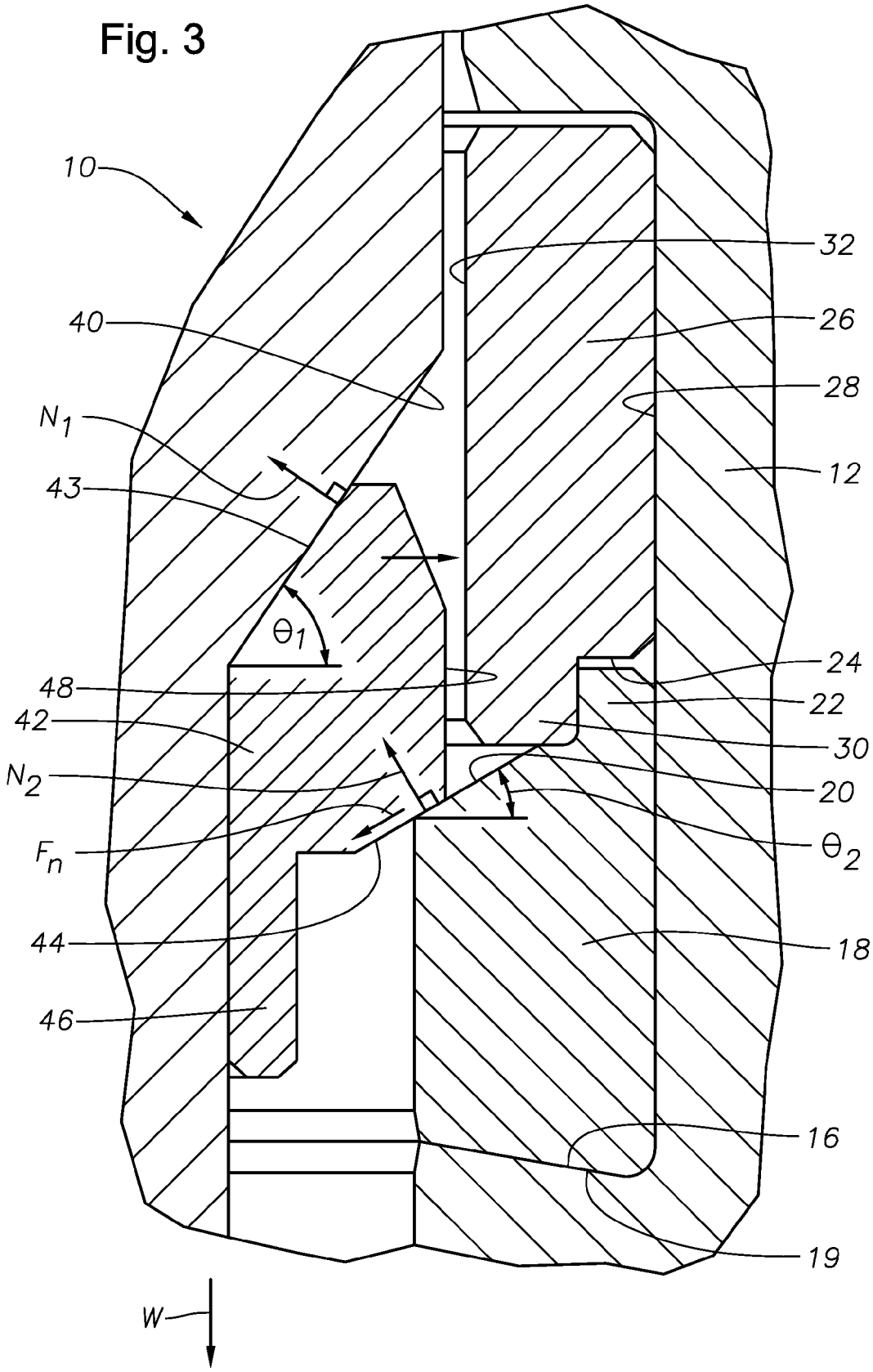
FIG. 3 is an enlarged side sectional view of the mating and landing surfaces of the hanger load ring, in accordance with the invention.

During setting operations, the hanger load ring 42 begins to expand radially outward as the weight "W" of the casing supported by the casing hanger 10 increases, as shown in FIG. 3. When the casing weight W is great enough to overcome the normal force N and frictional resistance Fn, the hanger load ring 42 will expand radially outward, causing the tapered shoulder 44 of the hanger load ring 42 to slide relative to the load shoulder 20 on the housing load ring 18. In this example, the angle $\theta_1$ i.e. the angle between the tapered shoulder 43 of the hanger load ring 42 and a horizontal axis, is greater than angle $\theta_2$ i.e. angle between the tapered shoulder 44 of the hanger load ring 42 and a horizontal axis. A differential angle, i.e. the difference between $\theta_1$ and $\theta_2$, may range from about between 10 degrees to 35 degrees. However, other angle pairs may be used to obtain a differential angle. The higher the differential angle the greater is the radial expansion of the hanger load ring 42. The differential angle can be preferably between 25 degrees to 30 degrees. Friction may also be a factor in the expansion of the load ring 42, with lower friction resulting in greater expansion and vice versa. Further, within the 10 to 35 degree differential angle, radial expansion could begin from about 0.001 inches to 0.080 inches. In an example, where hanger load ring 42 is fabricated from a high strength alloy steel with a yield strength of 250 ksi, a 0.075 inch radial expansion could be utilized as a benchmark to maintain elasticity of the material. As an example, the high strength steel alloy with desirable expansion can have a Young's modulus of $30\times10^6$. Other materials with different properties can also be used to fabricate load rings and thus allowable radial expansion can vary. For example, titanium allows for a wider range of radial expansion than discussed above. The radial expansion of the load ring 42 thus depends on the differential angle, elastic strain, casing weight and frictional resistance offered from the surfaces of contact. The hanger load ring 42 begins to elastically expand when energized by the casing weight W, provided that the tapered surface 44 is in complete contact with the upward shoulder 20 of the housing load ring 18.

When set, the load rings 42, 18 and shoulders 40, 16 provide a path for the casing load to be transferred to the wellhead housing 12. This invention provides some of the benefit of a traditional expanding load shoulder without the major drawback of having a mechanism that can trigger unexpectedly. Because the load shoulders 43, 44 are part of the solid hanger load ring 42, with no interruptions or weakened points, it should remain as reliable as a solid casing hanger.

However, the hanger load ring 42 also advantageously expands with increased casing hanger loads. The hanger 10 can thus be rated to a higher load carrying capability due to the increase in bearing contact area between load shoulders 43, 44 made available as the casing weight is increased.

As previously explained, the inner surface 32 of the retainer ring 26 acts to stop the hanger load ring 42 from expanding past its elastic properties by contacting the exterior surface 48 of hanger load ring 42 before inelastic or permanent deformation occurs. The width or thickness 50 of the retainer ring 26 may be tuned to match the amount of elastic expansion desired for the hanger load ring 42. When the weight W of the casing is removed from the hanger 10, the hanger load ring 42 is deenergized and returns to its retracted position. The casing load ring 42 along with the hanger 10 may then be retrieved if desired.

The invention has significant advantages. Premature activation of the activation ring is prevented and integrity of load shoulders is increased due to solid load ring. Further, the hanger load ring is weight energized, eliminating the need for an additional, external activation mechanism. This design may further be applied to any set of casing hangers to allow greater load carrying capability. Additionally, the invention allows the hanger load ring to drift through tag shoulders rather than getting caught and sticking at that incorrect point.

While the invention has been shown in only two of its forms, it should be apparent to those skilled in the art that it is not so limited but is susceptible to various changes without departing from the scope of the invention.

The invention claimed is:

1. A subsea wellhead assembly, comprising:

a housing having a bore, a longitudinal axis, and containing at least one housing upward facing conical load shoulder;

a hanger that is lowered into the housing, the hanger having at least one hanger downward facing conical load shoulder; and a load ring having a load ring downward facing conical shoulder, wherein the load ring is carried by the hanger for movement between a retracted position, wherein the load ring extends a full 360 degrees around an axis of the hanger and the load ring downward facing load conical shoulder is spaced radially overlapping and in contact with a portion of the housing upward facing load conical shoulder, and a radially expanded position wherein the load ring extends a full 360 degrees around the axis of the hanger, and the load ring downward facing lead conical shoulder has a greater surface area in engagement with the housing upward facing conical load shoulder than while in the retracted position that expands within elastic limits of the load ring.

2. The assembly according to claim 1, further comprising a retaining member located within the bore of the housing above the housing upward facing load shoulder and having an inward facing surface that is contacted by an outer diameter surface of the load ring when the load ring is expanded.

3. The assembly according to claim 2, wherein an annular clearance exists between the retaining member and the load ring while the load ring is in the retracted position.

4. The assembly according to claim 2, wherein the inward facing surface the retaining member has an inner diameter selected to prevent inelastic expansion of the load ring while moving to the expanded position.

5. The assembly according to claim 1, wherein the housing upward facing conical load shoulder has a larger radial width than the hanger downward facing conical load shoulder.

6. The assembly according to claim 1, wherein the hanger downward facing conical load shoulder is inclined at a first angle relative to the axis;

the load ring downward facing conical shoulder is inclined at a second angle relative to the axis that is greater than the first angle.

7. The assembly according to claim 1, further comprising:

a housing load ring mounted in a recess in the housing upward facing conical load shoulder, the housing load ring defining the load shoulder.

8. The assembly according to claim 1, wherein the load ring is moved from the retracted to the expanded position in response to a downward force applied to the hanger.

9. The assembly according to claim 1, wherein:

the load ring has a load ring upward facing conical shoulder that slides on the hanger downward facing conical load shoulder and the load ring downward facing conical load shoulder slides on the housing upward facing conical load shoulder while moving from the retracted to the expanded position.

10. A subsea wellhead assembly, comprising:

a housing having a bore, a longitudinal axis, and containing at least one housing upward facing conical load shoulder;

a hanger that is lowered into the housing, the hanger having at least one hanger downward facing conical load shoulder;

a load ring having a load ring downward facing conical shoulder, wherein the load ring is carried by the hanger for movement between a retracted position, wherein the load ring downward facing load conical shoulder is spaced radially overlapping and in contact with a portion of the housing upward facing load conical shoulder, and a radially expanded position wherein the load ring downward facing conical shoulder has a greater surface area in engagement with the housing upward facing conical load shoulder then while in the retracted position that expands within elastic limits of the load ring, wherein, the load ring is a solid metailic member that extends a full 360 degrees around the hanger when in the retracted position and when in the radially expanded position;

the housing upward facing conical load shoulder has a larger radial width than the hanger downward facing conical load shoulder the load ring has a load ring upward facing conical shoulder that slides on the hanger downward facing conical load shoulder and the load ring downward facing conical load shoulder slides on the housing upward facing conical load shoulder while moving from the retracted to the expanded position; and a retaining member located within the bore of the housing above the housing upward facing load shoulder and having an inward facing surface that is contacted by an outer diameter surface of the load ring when the hanger is expanded.

11. The assembly according to claim 10, wherein an annular clearance exists between the retaining member and the load ring while the load ring is in the retracted position.

12. The assembly according to claim 10, wherein the inward facing surface of the retaining member has an inner diameter selected to prevent inelastic expansion of the load ring while moving to the expanded position.

13. The assembly according to claim 10, further comprising:

housing load ring mounted in a recess in the housing upward facing conical load shoulder, the housing load ring defining the load shoulder.

14. The assembly according to claim 10, wherein the load ring is moved from the retracted to the expanded position in response to a downward weight of casing.

15. A method for installing a hanger in a subsea wellhead housing assembly, comprising:

providing the hanger with a load shoulder and mounting a load ring to the hanger in engagement with the load shoulder and that extends a full 360 degrees around the hanger;

lowering the hanger into the housing, and landing the load ring on a housing load shoulder;

securing a string of casing to the hanger;

applying a casing weight of the string of casing to the hanger, causing the load ring to expand radially outward on the housing load shoulder to a radially expanded position so that the load ring extends a full 360 degrees around the axis of the hanger; and limiting the expansion of the load ring such that the expansion is elastic.

16. The method of claim 15, further comprising increasing a contact area between the load ring and the housing load shoulder as the casing weight increases.

17. The method of claim 15, wherein, the load ring slides on the housing load shoulder while moving to the expanded position.

18. The method of claim 15, further comprising lifting the hanger to retrieve the casing, which removes the casing weight on the load ring and allows the load ring to return to the retracted position.

19. The method of claim 15, wherein the load ring slidingly engages the hanger load shoulder and slidingly engages the housing load shoulder while moving to the expanded position.

20. The method or claim 15, wherein mounting the load ring to the hanger comprises mounting a solid annular steel member to the hanger.

* * * * *